United States Patent [19]

Wallace

[11] Patent Number: 5,043,839

[45] Date of Patent: Aug. 27, 1991

[54] ELECTRONICALLY MONITORED AND CONTROLLED ELECTROSTATIC DISCHARGE FLOOR STRUCTURE

[75] Inventor: William D. Wallace, Fort Worth, Tex.

[73] Assignee: LTV Aerospace and Defense Company, Dallas, Tex.

[21] Appl. No.: 357,299

[22] Filed: May 26, 1989

[51] Int. Cl.[5] ..... H05F 3/00

[52] U.S. Cl. ..... 361/220; 361/216; 340/604; 156/273.9

[58] Field of Search ..... 361/212, 216, 220; 340/649, 650, 604, 605; 156/71, 273.9, 297, 299, 300

[56] References Cited

U.S. PATENT DOCUMENTS

| | | | |
|---|---|---|---|
| 2,325,414 | 7/1943 | McChesney et al. | 361/220 |
| 2,378,623 | 6/1945 | Donelson et al. | 361/216 |
| 2,413,610 | 12/1946 | Donelson | 361/216 |
| 2,851,639 | 9/1958 | Ford et al. | 361/216 |
| 3,121,825 | 2/1964 | Abegg et al. | 361/215 |
| 3,386,001 | 5/1968 | Slosberg et al. | 361/220 |
| 3,845,353 | 10/1974 | Shirai et al. | 361/220 |
| 4,246,575 | 1/1981 | Purtell et al. | 340/605 |
| 4,308,568 | 12/1981 | Whewell | 36/216 |
| 4,538,141 | 8/1985 | Feldman | 340/604 |
| 4,649,374 | 3/1987 | Hoigaard | 340/573 |
| 4,699,677 | 10/1987 | Rooklyn | 156/71 |
| 4,885,659 | 12/1989 | Nowell et al. | 361/220 |

FOREIGN PATENT DOCUMENTS

| | | | |
|---|---|---|---|
| 2445737 | 4/1976 | Fed. Rep. of Germany | 361/216 |

*Primary Examiner*—J. R. Scott
*Assistant Examiner*—Jeffrey A. Gaffin
*Attorney, Agent, or Firm*—Richards, Medlock & Andrews

[57] ABSTRACT

The flooring structure of this invention controls electrostatic charges. The normal presence of moisture will not affect the flooring structure's ability to control electrostatic charges. A moisture detector circuit will, however, indicate the presence of moisture, and can activate means for drying this moisture. The resistance of the flooring structure can be adjusted so that electrostatic charges are dissipated at different rates. Multiple flooring structures with different resistance values can be placed side by side.

49 Claims, 5 Drawing Sheets

ELECTRONICALLY MONITORED AND CONTROLLED ELECTROSTATIC DISCHARGE FLOOR STRUCTURE

TECHNICAL FIELD OF THE INVENTION

This invention relates in general to electrostatic discharge flooring, and in particular to a moisture resistant electrostatic discharge flooring structure having a resistance that can be monitored and adjusted, the flooring structure further including a moisture detector and means for drying moisture.

BACKGROUND OF THE INVENTION

In many facilities, the normal movement of individuals or equipment across floors can generate electrostatic charges. The conducting or sparking of these electrostatic charges can cause serious problems with equipment and products. Electrostatic charges can also create malfunctions in the internal circuitry of electrical equipment being manufactured or being used in particular facilities. Computer equipment, for example, is prone to malfunctions caused by electrostatic charges. When manufacturing electrical components, especially integrated circuit chips, the avoidance of electrostatic charge is critical because such components are extremely charge sensitive.

In facilities using combustible or explosive materials, sparking can result in dangerous explosions or fires. In hospitals, sparking near an oxygen source can increase the chances of fire. Sparking can also affect charge sensitive electrical equipment being used in care units or operating rooms. Such sparking can even affect the physical condition of a patient being operated on.

Because of the problems and dangers associated with electrostatic charges, various standards have been set requiring facility floors to meet minimum resistance values and to dissipate electrostatic charges at a minimum rate. For example, the NFPA (National Fire Protection Association) 99 standard requires that the resistance of a floor be more than an average of 25,000 ohms. When measuring the resistance of a floor according to the NFPA 99 standard, a five pound metal weight is placed on the floor, and the resistance from the weight to ground is measured. Several measurements at different points on the floor should be made, and the measurements are averaged to get a value for the floor resistance.

For military purposes, the federal government classifies flooring structures as being conductive, anti-static or dissipative. A flooring structure is considered anti-static if it has a resistance of $10^9$ to $10^{14}$ ohms per square. A flooring structure with this resistance does not create any static electricity but discharges static charges at a very slow rate. Materials that are insulators have resistances of higher than $10^{14}$ ohms per square. Flooring structures with resistances between $10^5$ and $10^9$ ohms per square are considered dissipative. Dissipative flooring structures do not create any electrostatic charges and discharge any existing electrostatic charges at a quick rate. Conductive flooring structures have resistances of less than $10^5$ ohms per square and discharge electrostatic electricity at a very quick rate, but this rate might be so fast as to create a surge capable of damaging electrical components. Anti-static floor structures are effective in some applications, but electrostatic dissipative or discharge flooring structures are useful in most applications.

To eliminate problems associated with electrostatic charges, and to meet the established resistance standards, various floor composition designs have been attempted to prevent the conduction of electrostatic charges and dissipate these electrostatic charges through ground. Although insulative materials prevent the conduction of electrostatic charges, they have been found to be undesirable because they may allow electrostatic charges created by frictional effects to accumulate. See U.S. Pat. No. 2,325,414 by McChesney et al. Surface materials of a hard metallic nature are highly conductive. As discussed above, conductive materials discharge electrostatic charges at a rapid rate, but the rate of discharge might be too rapid, creating a surge. These hard metallic materials are also undesirable since they could produce sparks if struck by another metal object. See U.S. Pat. No. 3,121,825 by Abegg et al. Semiconductive floor materials were developed to overcome the problems associated with insulating and conducting materials. These semiconductive floor materials, such as semiconducting rubber, and thermoplastic floor tiles containing flakes of conductive material, were designed to have a resistance value such that the material does not accumulate electrostatic charges and discharges electrostatic charges at a sufficient rate.

The principal problem with semiconductive floor materials is that it is difficult to achieve an even distribution of the insulating and conducting material used in fabricating the semiconductive material. This can result in an uneven distribution of electric charges, and varying degrees of electrostatic charge dissipation. To eliminate these problems, conductive screens or meshes have been imbedded in the semiconductive material and attached to a ground terminal. The concept for this type of flooring is that the electrostatic charges travel only short distances in the semiconductive material before they pass through the highly conductive mesh or screen to ground, and since this screen or mesh is uniformly imbedded throughout the semiconductive material, the discharge of the electrostatic charges is uniform throughout.

However, there are several reasons why even these flooring materials fail to adequately discharge the electrostatic charges. Over a period of time, the conductivity and resistance of the semiconductive material, the conductive screen or mesh, and any materials used to affix the layers together or to affix the flooring to ground tends to change. Furthermore, moisture, which is a common occurrence in flooring, not only damages these floors but also causes them to become more conductive than designed.

From the foregoing, it can be seen that a need exists for a flooring structure that dissipates electrostatic charges within adopted standards, and has a resistance that can be monitored and changed to insure that the flooring structure has the desired resistivity. Furthermore, a need exists for an electrostatic discharge controlling flooring structure that is not affected by the first occurrences of moisture, and that contains a monitor for sensing the presence of such moisture. A further need exists for a flooring system made up of multiple flooring structures insulated from each other so that each flooring structure of the flooring system can have a different resistance.

SUMMARY OF THE INVENTION

A flooring structure with different layers is placed on top of a flat rigid surface such as a concrete floor. The flooring structure includes a bottom layer of interlocking modular cushion tiles. The modular cushion tiles are good insulators, and are moisture resistant. The modular cushion tiles comprise a planar body supported by support members. The spaces between the planar body and the concrete floor created by the spaces between the support members, provide space for collecting moisture, thereby preventing moisture from seeping towards the upper layers of the flooring structure. Strips of conductive tape are affixed on top of the bottom layer. A layer of conductive epoxy, which acts as an adhesive, is then placed on top of the strips of conductive tape and the areas of the bottom layer not covered with the conductive tape. Semiconductive tiles are then placed on top of the layer of conductive epoxy after a prescribed time period. The semiconductive tiles are placed next to each other.

The strips of conductive tape should be arranged in a lattice arrangement. The lattice arrangement of the conductive tape and the positioning of the semiconductive tiles should be such that the conductive tape overlaps the perimeter of each semiconductive tile on the underside of the semiconductive tiles. The conductive tape is wide enough so that a strip of conductive tape will overlap one side of the perimeter of a semiconductive tile and overlap one side on the perimeter of an adjacent semiconductive tile. A ground wire is attached to the conductive tape at one of the corners of the flooring structure. The ground wire leads to a variable resistance circuit and then to electrical ground. Conductive foam material, which becomes more conductive as it absorbs moisture, is placed under the planar body in the space between the support members. Conductive tape is attached to the top and bottom of the conductive foam material. Wires are attached to the conductive tape. These wires lead to a moisture detector circuit. A molding strip is affixed around the periphery of the flooring structure.

The resulting flooring structure is strong, resilient, durable, and moisture resistant. The electrical properties of the flooring structure are such that electrostatic charges are dissipated at a desired rate. Electrostatic charges that are present do not accumulate, rather they are drawn into the semiconductive tiles. Then, the charges are drawn from the semiconductive tiles into the more conductive layers containing the conductive epoxy layers and the conductive tape. Finally, the charges are dissipated to ground.

As electrostatic charges are attracted to ground, they are also discharged by the resistance of the materials used to make the flooring structure. A problem is that the resistance of the flooring structure materials tends to change by temperature, humidity and aging. This invention solves this problem by the insertion of a variable resistance between the conductive tape and ground. An ohmmeter is connected across the variable resistance to determine its resistance value. If the ohmmeter is working, this indicates that the flooring structure is properly grounded.

Although the flooring structure works well even in the presence of moisture, moisture might eventually pose problems to the flooring structure. Furthermore, the very presence of moisture should be investigated. Therefore, this invention includes a moisture detector which detects the presence of moisture under the planar body of the bottom layer. When moisture is present, the conductive foam material placed under the bottom layer becomes more conductive and completes a circuit which activates an alarm. The circuit can be adjusted so that it is more or less likely to alarm when there is a presence of moisture. Centrifugal blowers, which dry moisture, can be activated when moisture is present under the planar body of the bottom layer. Two centrifugal blowers should be installed on opposite ends of the flooring structure. One centrifugal blower blows air under the planar body while the other centrifugal blower sucks in this air and blows the air out of the sides of the centrifugal blower.

An electronic control box can be used to consolidate the monitoring and controlling of the variable resistance circuitry and the moisture detector circuitry. Several flooring structures, which are insulated from each other by the molding strip, can be placed side by side. The resistance of adjacent flooring structures can be connected in series so that the resistance of one flooring structure is increased by the value of the resistance of the adjacent flooring structure. The resistance of each flooring structure can be set to a different value.

BRIEF DESCRIPTION OF THE DRAWINGS

Further features and advantages will become apparent from the following and more particular description of the preferred embodiment of the invention, as illustrated in the accompany drawings in which like reference characters refer to the same elements or functions throughout the views, and in which.

DETAILED DESCRIPTION

It is to be understood that while the drawings best illustrate the features of the invention, the drawings are not necessarily to scale.

Figure 1:
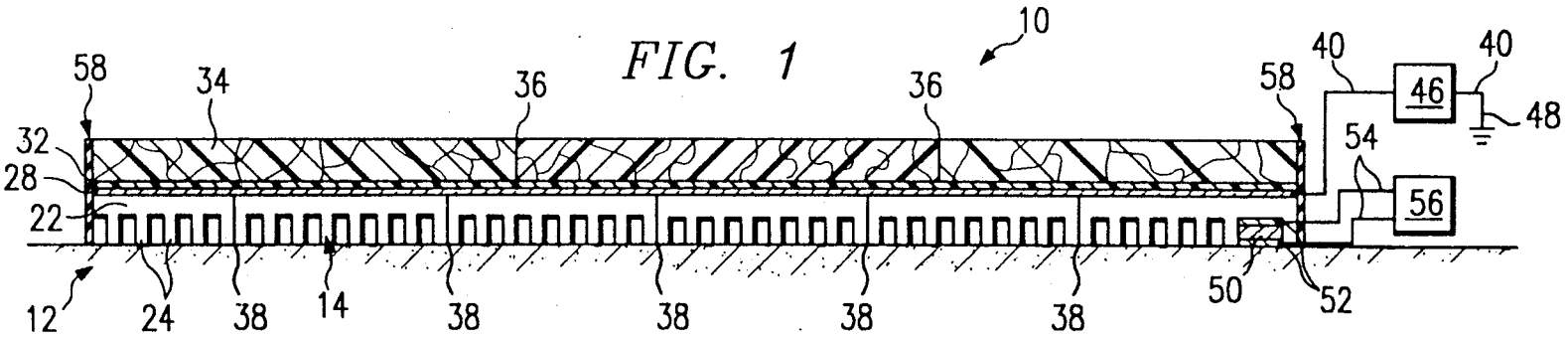
FIG. 1 is a cross sectional view of the flooring structure of the invention.
Figure 1A:
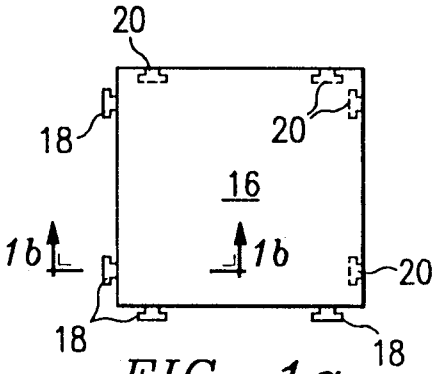
FIG. 1*a* is a top view of one of the bottom layer tiles of the flooring structure.
Figure 1B:
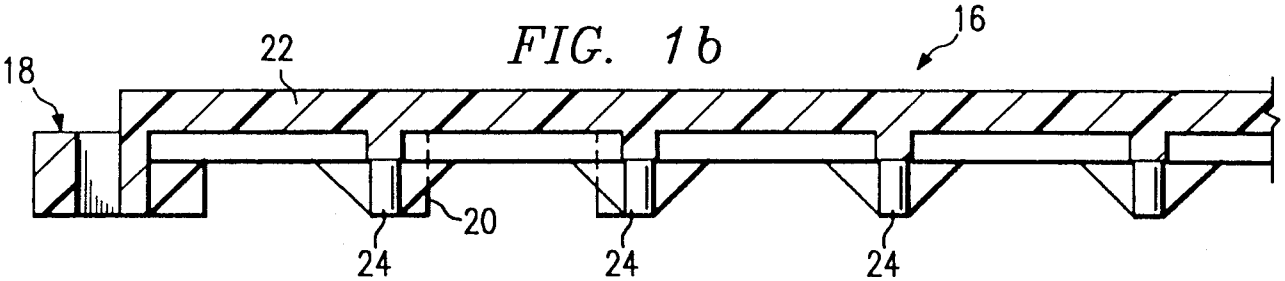
FIG. 1*b* is an enlarged cross-sectional view taken along lines 1*b*—1*b* of the bottom layer tile of FIG. 1*a*.

FIG. 1 illustrates different layers of a flooring structure 10 for the present invention, and illustrates connections to electronic circuitry. For best results, the flooring structure 10 should be placed on top of a flat rigid surface, such as a concrete flooring 12. Floor structure 10 includes a bottom layer 14 of interlocking modular cushion tiles 16. Modular cushion tiles 16 are made by Plastic Safety Systems, Inc. These modular cushion tiles 16 are made of polyvinyl chloride and come in sizes of 12 inches by 12 inches by ¾ inches high. Two sides of each modular cushion tile 16 have two male T tabs 18, while the other two sides of each modular cushion tile 16 have two female T slots 20. Modular cushion tiles 16 are placed next to each other with the male T tabs 18 of one modular cushion tile 16 locked into the female T slots 20 of an adjacent modular cushion tile. Thus, bottom layer 14 can be made up of any number of interlocking modular cushion tiles 16. The cross-sectional view of the modular cushion tiles (FIG. 1*b*) illustrates that the tiles comprise a planar body 22 supported by support members 24. The spaces between the planar body 22 and the concrete floor 12 created by the spaces between the support members 24, provide space for collecting moisture, thereby preventing moisture from seeping towards the upper layers of flooring structure 10. Modular cushion tiles 16 should have a flat surface or a surface with small depressions as is further discussed below. An alternative to using modular cushion tiles 16 for the bottom layer 14 is to use pieces of plywood as planar body 22 placed on top of wood members, such as which is commonly referred to as "two-by-fours" or "one-by-sixes" to act as support members 24.

Strips of conductive tape 28 are placed on top of bottom layer 14. The arrangement of conductive tape 28 will be described in further detail below. 3M makes conductive tape called Scotch TM Brand Foil Shielding Tapes. Scotch TM Foil Shielding Tape Nos. 1245 and 1345 have been found to have the best performance characteristics for the flooring structure 10. Tape No. 1245 is an embossed, dead soft, copper foil tape, with adhesive on the backing. The copper foil tape is conductive through the adhesive. This copper foil tape has the characteristics of static grounding and good solderability. Tape No. 1345 is an embossed, dead soft, tin-alloy coated (on both sides) copper foil tape, with an adhesive on the backing. This tape is also conductive through the adhesive. The characteristics of this tape are static grounding, the greatest solderability, and the greatest corrosion resistance of the Scotch TM Brand Foil Shielding Tapes. Conductive tape 28 is affixed to the top of bottom layer 14 by the adhesive backing of the conductive tape. An alternative to using conductive tape 28 is to use a metal screen or mesh.

Next, a layer of conductive epoxy 32, which acts as an adhesive, is placed on top of conductive tape 28, and areas of bottom layer 14 not covered with the conductive tape. The modular cushion tiles 16 can be designed to have small depressions in its surface so that the conductive epoxy 32 will seep into the exposed depressions not covered by semiconductive tape 28 and create greater bonding between the modular cushion tiles and the conductive epoxy. American Halmitins makes a conductive epoxy called Helmicol No. 3022 which is a carbon-loaded epoxy. The resistivity of Helmicol No. 3022 can be changed by changing the concentration of the carbon. For example, a large concentration of carbon in the mix will make the conductive epoxy more conductive.

Figure 2:
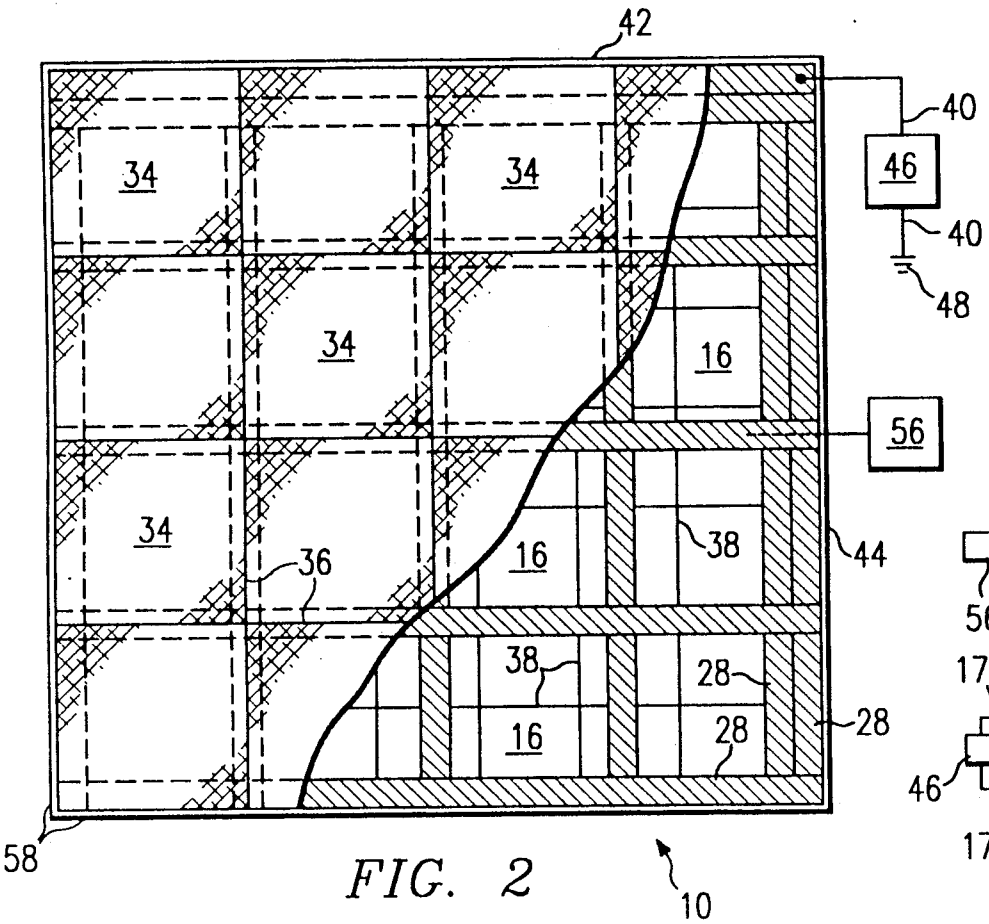
FIG. 2 is a top view of the flooring structure with layers partially broken away to illustrate the structure.

After waiting fifteen minutes, semiconductive tiles 34 are placed on top of the layer of conductive epoxy 32. The fifteen minute wait improves the bonding co qualities of conductive epoxy 32. Flexco ® Company manufactures semiconductive tiles which are made of vinyl impregnated with carbon particles. These semiconductive tiles are available in sizes of one foot by one foot, two feet by two feet, three feet by three feet, or in rolls of much larger sizes. Tiles of three feet by three feet or two feet by two feet have been found to be effective. FIG. 2 illustrates the semiconductive tiles 34 as two feet by two feet in relation to the size of the one foot modular cushion tiles 16. As is shown in FIGS. 1 and 2, the semiconductive tiles 34 are placed next to each other. The semiconductive tiles 34 are arranged so that the seams 36 of the semiconductive tiles 34 do not overlap the seams 38 of the modular cushion tiles 16 below. This arrangement provides a much stronger floor structure. The seams 36 of the semiconductive tiles 34 should be sealed to prevent moisture from the surface, for example resulting from mopping the floor, from seeping into the lower layers of the flooring structure 10. A typical commercial technique used for sealing semiconductive tiles 34 is to place a vinyl bonding strip in the seams between the semiconductive tiles 34 and to fuse the vinyl bonding strip to the semiconductive tiles 34 by heat application.

The strips of conductive tape 28 under the semiconductive tiles 34 and the layer of conductive epoxy 32, should be arranged in a lattice arrangement (FIG. 2). The lattice arrangement of the conductive tape 28 and the positioning of the semiconductive tiles 34 should be such that the conductive tape 28 overlaps the perimeter of each semiconductive tile 34 on the underside of the semiconductive tiles 34 (FIG. 2). The conductive tape 28 should be wide enough so that a strip of conductive tape will overlap one side of the perimeter of a semiconductive tile 34 and overlap the side on the perimeter of an adjacent semiconductive tile. The Scotch TM Brand Foil Shielding Tapes come in widths of two inches, four inches, six inches, and thirty-six inches. The two inch foil shielding tape provides sufficient overlap of adjacent semiconductor tiles 34. As is shown in FIG. 2, when the conductive tape 28 is placed in this arrangement, it forms a lattice of conductive tape. As is also shown in FIG. 2, the seams 36 of the semiconductive tiles 34 are positioned along the center of each strip of conductive tape 28. Conductive tape 28 is also placed around the perimeter on top of bottom layer 14. A ground wire 40 is attached, for example by soldering, to the conductive tape 28 at one of the corners of the flooring structure 10 (FIG. 2). The two sides 42 and 44 of flooring structure 10 which meet at the point where ground wire 40 is attached have twice the width of conductive tape as compared to the rest of the conductive tape lattice. The greater width of conductive tape provides better conductivity to the ground wire 40.

Ground wire 40 leads to a variable resistance circuit 46 (described below) and then to electrical ground 48. The best grounding is achieved by attaching the ground wire 40 to the green wire ground of a main fuse box.

Conductive foam material 50, which becomes more conductive as it absorbs moisture, is placed under the planar body 22 of modular cushion tiles 16 in the space between support members 24. 3M manufactures conductive foam material 50 in a dense version and a less dense version. The dense conductive foam material is more moisture absorbent than the less dense version.

Conductive tape 52 is attached to the top and bottom of the conductive foam material 50. Wires are attached, for example by soldering to the conductive tape 52. These wires lead to a moisture detector circuit 56 (described below).

A molding strip 58 is affixed around the periphery of flooring structure 10 (FIG. 2). Molding strip 58 should be made of materials that make it an insulator, and make it moisture resistant. A molding strip made out of rubber or polyvinyl chloride will work. The combination of bottom layer 14, which is an insulator and which is moisture resistant, and molding strip 58 insures that flooring structure 10 is water resistant, and insulated around the periphery and the bottom from objects that might interfere with its electrostatic discharge properties.

Figure 3:
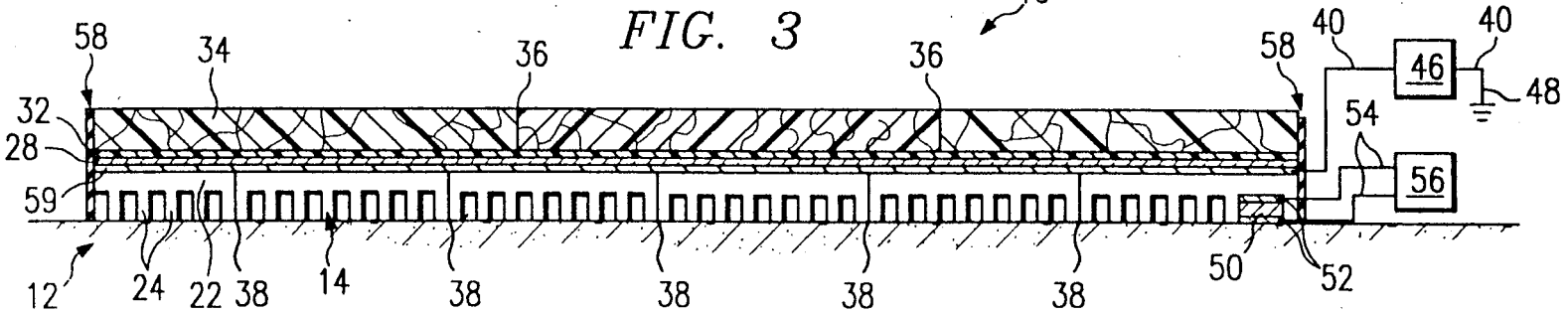
FIG. 3 is a cross-sectional view of an alternative embodiment of the flooring structure of the invention.

The resulting flooring structure 10 is strong, resilient, durable, and moisture resistant. Flooring structure 10 can withstand a force of at least 88 pounds per square inch. Thus, flooring structure 10 is unaffected by most heavy machinery and equipment. As is shown in FIG. 3, a 3/16 inch thick metal plate 59, with an area equal to the area of bottom layer 14, can be placed on top of bottom layer 14 before the conductive tape 28, conductive epoxy 32 and semiconductive tiles 34 are added. The addition of metal plate 59 increases the strength of flooring structure 10 so that it can withstand a force of well over 100 pounds per square inch.

Flooring structure 10 contains electrical properties such that electrostatic charges are dissipated at a desired rate. Electrostatic charges formed, for example by the movement of people or equipment, do not accumulate, rather the charges are drawn into the semiconductive tiles 34. Then, the charges are drawn from the semiconductive tiles into the more conductive layers containing conductive epoxy layer 32 and conductive tape 28. Finally, the charges are dissipated through ground wire 40 attached to conductive tape 28 to ground 48.

Figure 4:
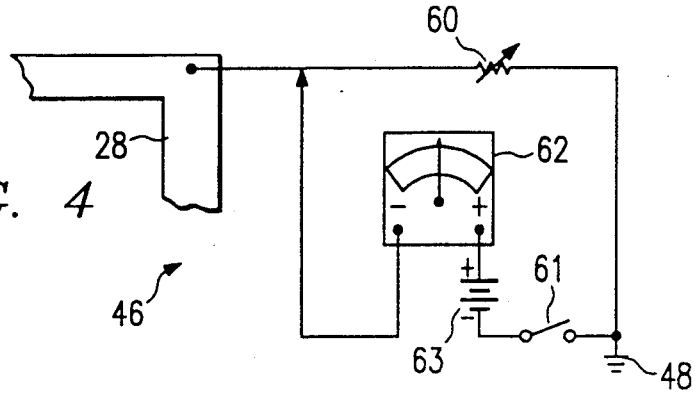
FIG. 4 illustrates the electronic circuitry for monitoring and adjusting the resistance of the flooring structure.

The dissipation rate of the charges depends on the resistance of the materials used to make flooring structure 10. A higher resistance slows the dissipation rate, while a lower resistance increases the dissipation rate. A problem is that the resistance of the materials (the semiconductive tiles 34, the conductive epoxy layers 32 and the conductive tape 28) tends to change by such factors as temperature, humidity and aging. This invention solves this problem by the insertion of a variable resistance 60 in the ground wire 40 between the conductive tape 28 and ground 48. A decade box, a wirewound rheostat, or a potentiometer may be used for the variable resistance 60. An ohmmeter 62 is connected across variable resistance 60 to determine its resistance value. A 1.5-volt battery 63 in series with ohmmeter 62 powers the ohmmeter. A switch 61 is used to activate ohmmeter 62. The circuit containing variable resistance 60 and ohmmeter 62 is designated as 46 (FIG. 4). Thus, whenever the resistance of the flooring structure 10 varies from the desired value, the variable resistance 60 can be adjusted accordingly. Increasing the resistance decreases the dissipation rate, while decreasing the resistance increases the dissipation rate.

As discussed, bottom layer 14 comprises a planar body 22 which is raised above the concrete floor 12 by support members 24 so as to prevent any moisture from seeping up to the upper layers. Therefore, the flooring structure 10 works well even in the presence of moisture. However, such moisture might eventually pose problems to the flooring structure 10 if there are significant amounts of this moisture and the moisture is present for long periods of time. Furthermore, the very presence of moisture should be investigated. Therefore, this invention includes a moisture detector 56 which detects the presence of moisture under planar body 22 of bottom layer 14.

As discussed and as illustrated in FIG. 1, conductive foam material 50 is placed under planar body 22 of bottom layer 14. Conductive foam material 50 can be placed in as many areas under bottom layer 14 as desired to detect moisture in remote areas under flooring structure 10. However, since the surface upon which flooring structure 10 is placed is usually flat, the moisture on the surface will usually uniformly spread throughout the surface so that a minimum amount of conductive foam material 50 need be placed under bottom layer 14 to detect moisture.

Figure 5:
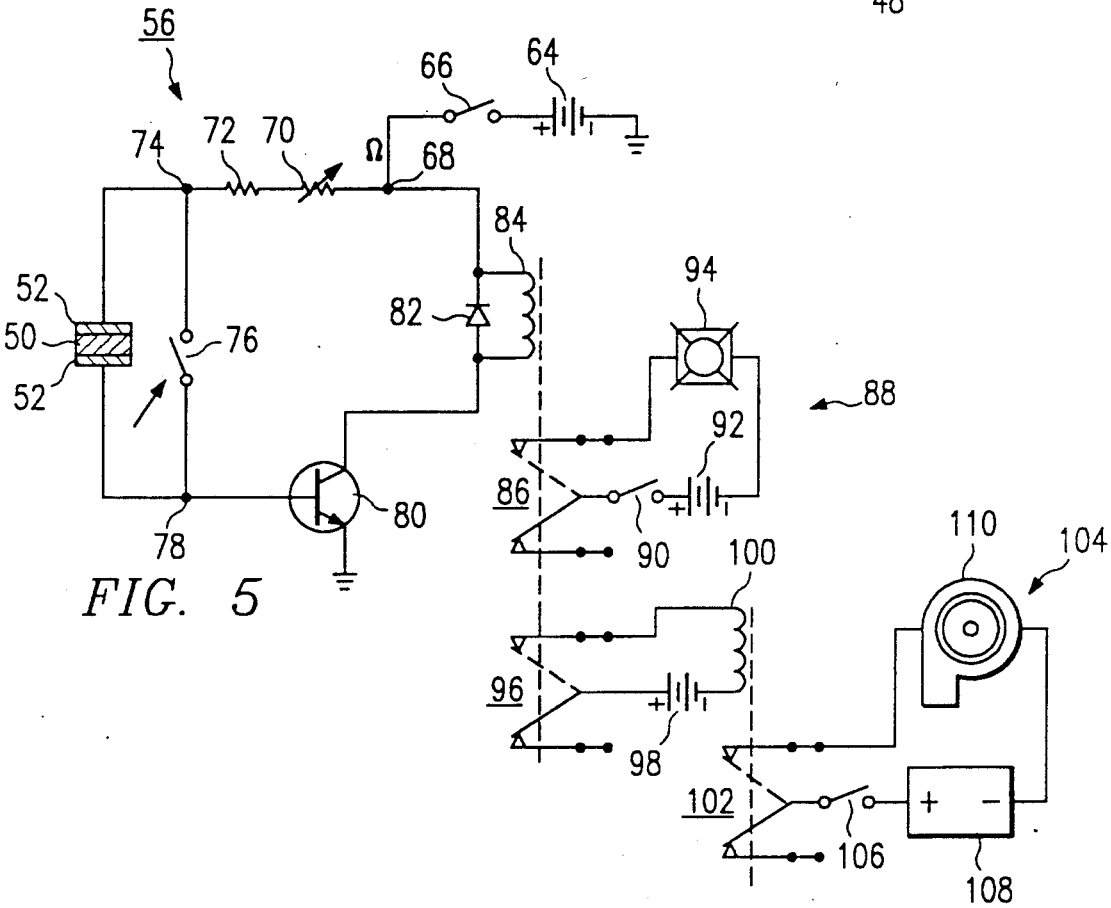
FIG. 5 illustrates the electronic circuitry for detecting moisture and for drying moisture under the flooring structure.

Moisture detector circuit 56 includes (FIG. 5) a 9-volt battery 64 which has one terminal connected to ground and the other terminal connected to a switch 66. Switch 66 is connected in series between battery 64 and node 68. A variable resistance 70 and a resistor 72 are connected in series between node 68 and a node 74. A switch 76 is connected between node 74 and a node 78. Node 78 is connected to the base terminal of a transistor 80. The emitter of transistor 80 is connected to ground and the collector is connected to the anode of a diode 82. The cathode of diode 82 is connected to node 68. A relay 84 is connected in parallel with diode 82. Relay 84 serves to activate a pole switch 86 to close a contact and complete an alarm circuit 88. The alarm circuit 88 comprises a switch 90 in series with a battery 92 and a light or sound alarm 94. Relay 84 also serves to activate a pole switch 96 to close a contact and complete a circuit of a 9-volt or 12-volt battery 98 in series with a relay 100. Relay 100 serves to activate a pole switch 102 to close a contact and complete a blower circuit 104. Blower circuit 104 comprises a switch 106 connected in series with an 115-volt AC power source or a 24-volt DC power source 108 and a centrifugal blower 110.

The moisture detector circuit 56 works as follows. Switch 66 is normally closed while switch 76 is normally open. Switch 66 serves to disconnect the 9-volt battery 64 from the rest of the circuit. When there is no moisture underneath flooring structure 10, the conductive foam material 50 has a very high resistance. If conductive foam material 50 has a very high resistance and if switch 76 is open, then the base-emitter voltage will be too low to turn on transistor 80. If there is no moisture and switch 76 is closed, transistor 80 might or might not be turned on, depending on the values of resistor 72 and variable resistance 70. Resistor 72 is a set resistance of 5000 ohms. Variable resistance 70 can be adjusted, thus changing the base-emitter voltage of transistor 80, so that transistor 80 is turned on. Once this adjustment is made switch 76 is opened. Thus, if conductive foam material 50 becomes more conductive by the presence of moisture, and has a very low resistance, then transistor 80 will be turned on. Since conductive foam material 50 becomes more conductive and less resistive as it absorbs moisture, if only small amounts of moisture are present, conductive foam material 50 might still have a high resistance value. Therefore, variable resistance 70 can be adjusted so that the base-emitter voltage of transistor 80 is large enough to turn on transistor 80 even if a high resistance from conductive foam material 50 is added in series with resistor 72 and variable resistance 70. Variable resistance 70 can also be adjusted so that if small amounts of moisture are present and conductive foam material 50 has a high resistance, then the resistance of conductive foam material 50, resistor 72 and variable resistance 70 is too high resulting in the base-emitter voltage being too low to turn on transistor 80. In the latter situation, variable resistance 70 should be adjusted so that although transistor 80 does not turn on at low levels of moisture, if higher levels of moisture are present making conductive foam material 50 less resistive, the base-emitter voltage is large enough to turn on transistor 80.

When transistor 80 is on, current flows through relay 84 causing pole switch 86 to move in a closed position. Whenever pole switch 86 is opened and closed, a high-voltage spike is generated; diode 82 acts to short circuit this spike. Since switch 90 is normally closed, the closing of pole switch 86 creates a complete circuit for alarm circuit 88. Battery 92, which is then in series with alarm 94, sets off alarm 94 indicating the presence of moisture under the flooring structure 10. Switch 90 can be opened to shut off alarm 94. When current flow through relay 84, pole switch 96 also moves in a closed position creating a complete circuit for battery 98 in series with relay 100. Current then flows through relay 100 which causes pole switch 102 to move in a closed position creating a complete circuit for blower circuit 104. The power source 108 then activates centrifugal blower 110. Multiple blower circuits designed exactly like blower circuit 104 can be tied into relay 100. Switch 106 of blower circuit 104 is normally closed but can be opened to shut off centrifugal blower 110. Since alarm circuit 88 and blower circuit 104 are separate circuits, either circuit can be active, or can be shut off by its switch without affecting the other circuit.

Figure 6:
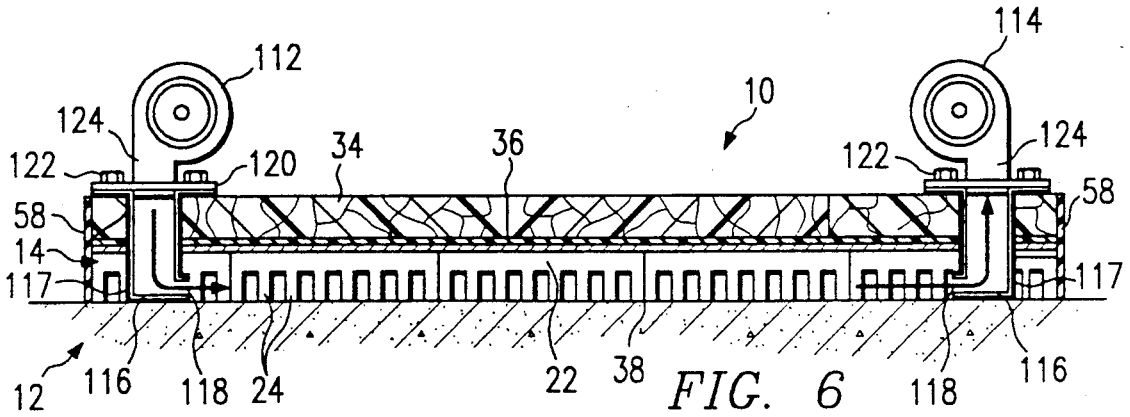
FIG. 6 is a cross-sectional view of the flooring structure with means for drying moisture installed in the flooring structure.
Figure 7:
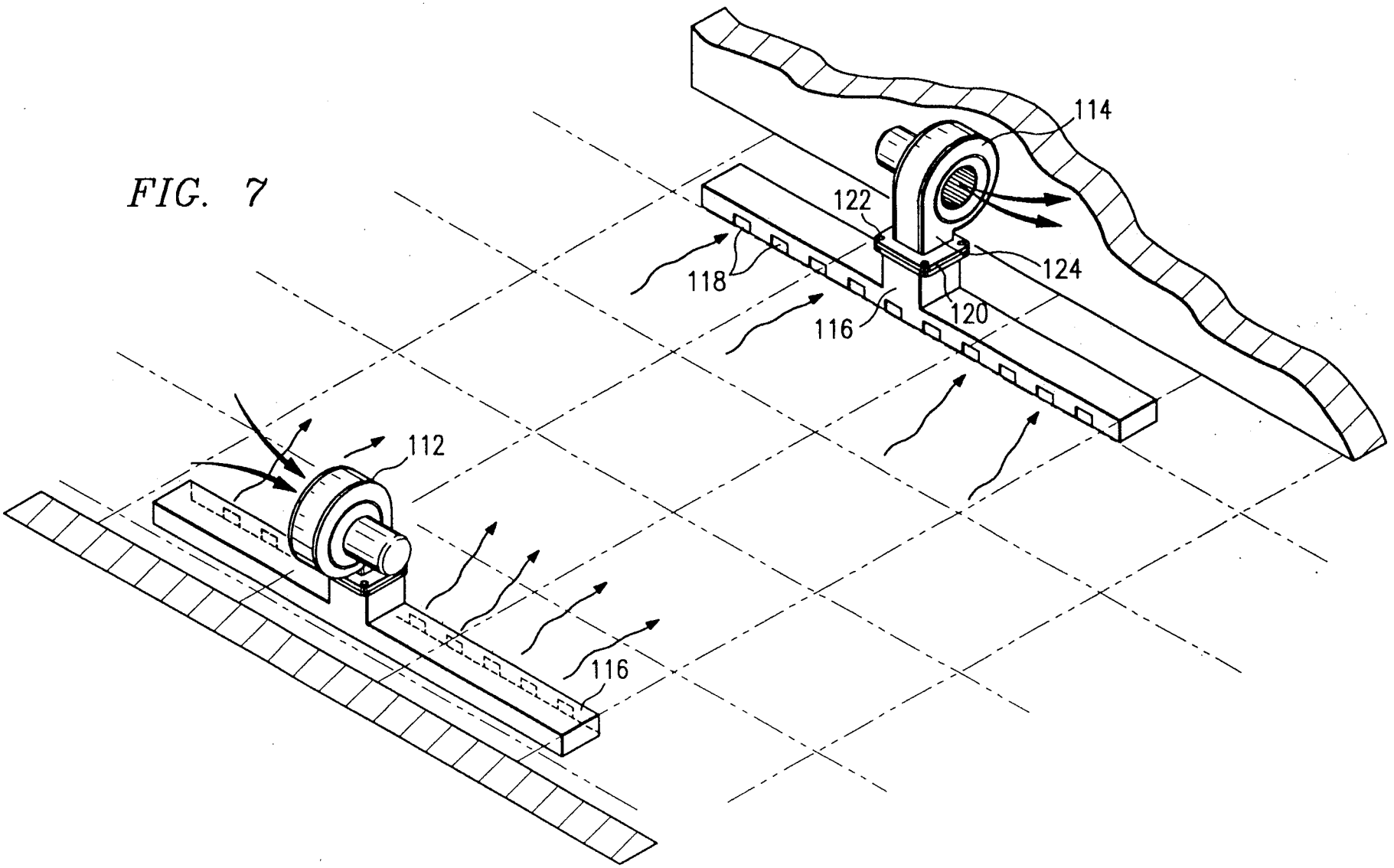
FIG. 7 is a perspective view from the top of the flooring structure illustrating means for drying moisture installed in the flooring structure.

Centrifugal blowers 110, which are activated as described above when moisture is present, are used to dry moisture under planar body 22 of bottom layer 14. FIGS. 6 and 7 illustrate how centrifugal blowers 110 are installed in flooring structure 10. Ideally, two blowers 112 and 114 should be installed on opposite ends of flooring structure 10. Centrifugal blowers 112 and 114 should be installed about 6 inches inward from their respective ends of flooring structure 10. A 1.5 inch by 6 foot opening is cut from the top to the bottom of flooring structure 10 at each end of flooring structure 10 where the centrifugal blowers 112 and 114 will be installed. Duct work 116 with vent openings 118 is placed into each opening cut into the floor structure 10. Duct work 116 should have its exterior covered with a layer of insulating material 117. The layer of insulating material 117 prevents the metal duct work 116 from interfering with the electrostatic discharge properties of flooring structure 10. The layer of insulating material 117 can be a rubber molding strip, or a silicone rubber general purpose sealant made by Dow Corning. When the duct work 116 is installed, vent openings 118 are under planar body 22 of bottom layer 14, and these openings face towards the middle of flooring structure 10. An outlet flange 120 attaches to duct work 116 and lies flat on top of semiconductive tile 24 surface. The outlet flange is bolted into flooring structure 10 through holes 122 in the outlet flange. When duct work 116 and outlet flanges 120 are installed, the centrifugal blowers 112 and 114 can be installed. Suitable centrifugal blowers are manufactured by Rotron. Each centrifugal blower 112 and 114 has a centrifugal blower outlet 124. This centrifugal blower outlet is inserted into outlet flange 120. Centrifugal blowers 112 and 114 are installed into their respective flanges in this manner.

Centrifugal blowers 112 and 114 should have opposite blower rotations. The centrifugal blowers are designed so that if the blower rotation is in one direction air comes in from the sides of the centrifugal blower and is blown out of the centrifugal blower outlet. If the centrifugal blower rotates in the opposite direction, air is sucked up through the centrifugal blower outlet and is blown out the sides of the centrifugal blower. The centrifugal blower rotation illustrated in FIGS. 6 and 7 is such that centrifugal blower 112 blows air out of its centrifugal blower outlet into duct work 116, and the air is blown out of the vent openings 118 under planar body 22 towards the middle of flooring structure 10. The rotation of centrifugal blower 114 is in the opposite direction and sucks the air flow from centrifugal blower 112 through its vent openings 118 into its outlet flange 120 where finally the air is blown out of the sides of centrifugal blower 114.

Figure 8:
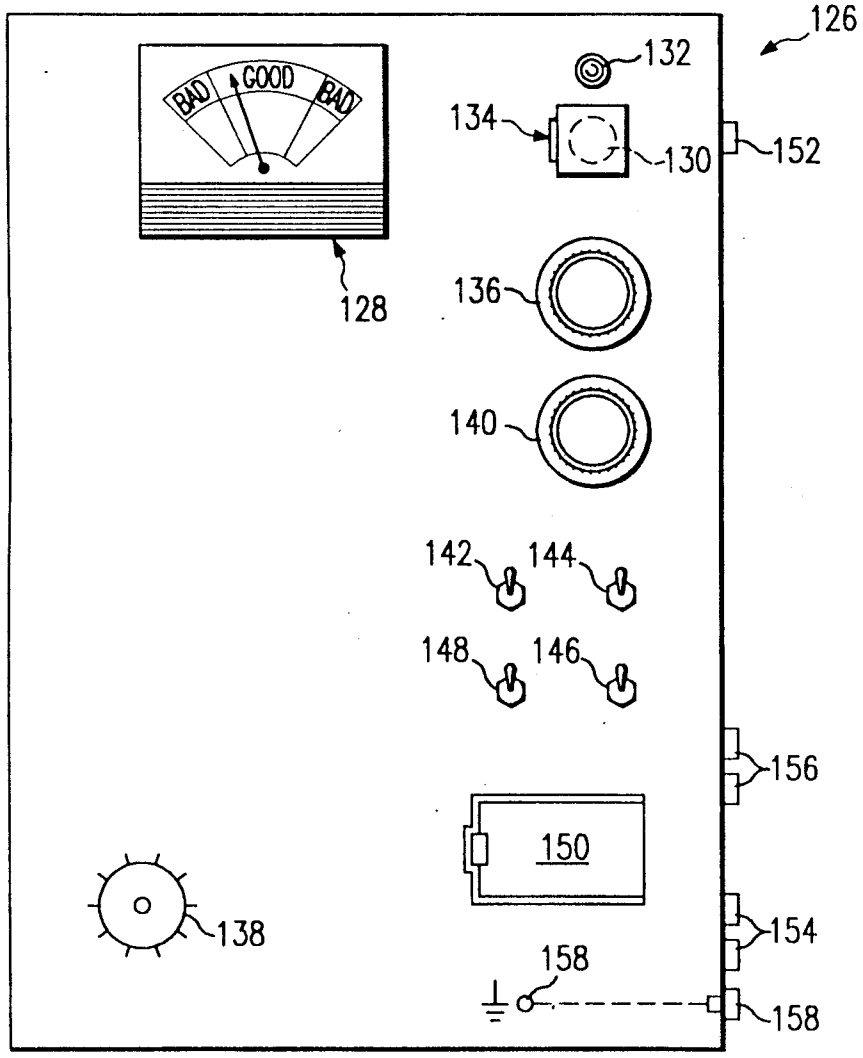
FIG. 8 illustrates the face of an electronic control box which consolidates the electronic circuitry illustrated in FIGS. 4–5.

Variable resistance circuit 46 and moisture detector circuit 56 can be consolidated into an electronic control box 126. FIG. 8 illustrates the face of electronic control 126. Electronic control box 126 includes an ohmmeter 128 which is powered by battery 130 when push button switch 132 is on. The electronic control box 126 has an access door 134 to access battery 130. Knob 136 is used to adjust the variable resistance 60 in variable resistance circuit 46. The electronic control box 126 has an alarm 138 which is the moisture detector circuit 56 alarm. Knob 140 is used to adjust the variable resistance 70 in moisture detector circuit 56. Electronic control box 126 has four on/off switches 142, 144, 146, and 148. On/off switch 142 is used to activate switch 66 in moisture detector circuit 56. On/off switch 144 is used to activate switch 76 of the moisture detector circuit 56. On/off switch 146 is used to activate switch 90 of the moisture detector circuit 56, and switch 148 is used to activate switch 106 of the moisture detector circuit. The electronic control box 126 also has an access door 150 which accesses batteries 64, 92 and 98 used in moisture detector circuit 56. Electronic control box 126 also has several plug-in or screw terminals. Ground wire 40 is plugged into or screwed to terminal 152. The two leads from centrifugal blower 110 are plugged into or screwed to terminals 154. The two wires 54 attached to the conductive tape on conductive foam material 50 are plugged into or screwed to terminals 156. Ground 48 is connected to electronic control box 126 through plug-in or screw terminals 158.

Figure 9:
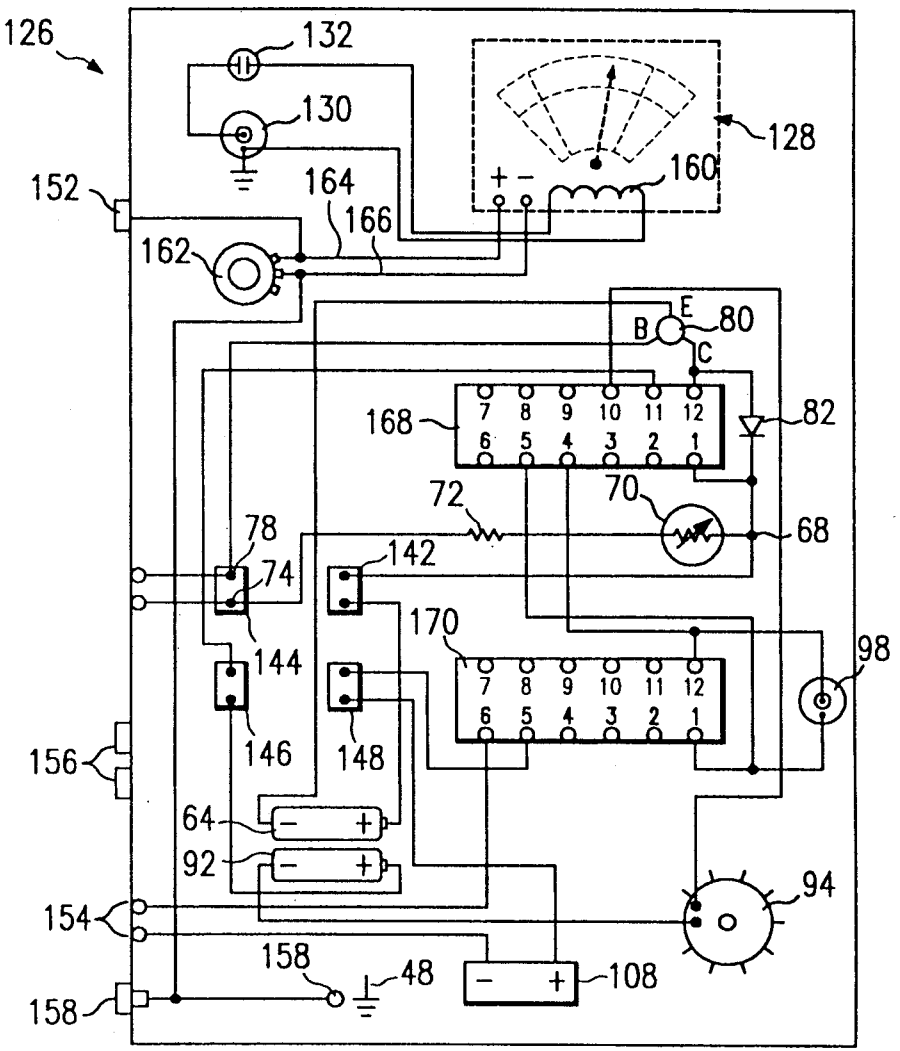
FIG. 9 is a wiring diagram of the internal circuitry of the control box in FIG. 8.

FIG. 9 is a wiring diagram of the internal circuitry of electronic control box 126. When push button switch 132 is on, this completes a circuit with battery 130 in series with a coil 160 which is part of ohmmeter 128. When battery 130 is in series with solenoid 160, this energizes coil 160 so that ohmmeter 128 is ready to make a resistance reading. The variable resistance 60 for variable resistance circuit 46 is illustrated as a potentiometer 162. Potentiometer 162 is connected in series with terminal 152, to which ground wire 40 is connected, and ground 48. Ohmmeter 128 is connected in parallel with potentiometer 162, by wires 164 and 166, to measure the resistance value of the potentiometer. When ohmmeter 128 is working, this also indicates that the flooring structure 10 is properly grounded.

The rest of the wiring diagram illustrates the circuitry of the moisture detector circuit 56 which includes alarm circuit 88 and blower circuit 104. The wiring diagram illustrates two relays 168 and 170. Relays 168 and 170 are numbered with twelve solder terminals. Battery 64 of the moisture detector circuit has one terminal connected to ground and the other terminal connected to switch 142. Switch 142 is connected in series between battery 64 and node 68. Variable resistance 70 and resistor 72 are connected in series between node 68 and a node 74. A switch 144 is connected between node 74 and a node 78. Node 78 is connected to the base terminal of transistor 80. The emitter of transistor 80 is connected to ground. The collector is connected to the anode of diode 82 and connected to terminal No. 12 of relay 168. The cathode of diode 82 is connected to terminal No. 1 of relay 168. Terminal No. 11 of relay 168 is connected to one terminal of switch 146. The other terminal of switch 146 is connected to the positive terminal of battery 92 of alarm circuit 88. The negative terminal of battery 92 is connected to one terminal of alarm 94. The other terminal of alarm 94 is connected to relay 168 at terminal No. 10. Terminal No. 4 of relay 168 is connected to terminal No. 12 of relay 170. Terminal No. 5 of relay 168 is connected to terminal No. 1 of relay 170. Battery 98, which energizes relay 170, has its positive terminal connected to terminal No. 12 of relay 170 and its negative terminal connected to terminal No. 1. Terminal No. 5 of relay 170 is connected to one terminal of switch 148. The other terminal of switch 148 is connected to the positive terminal of power source 108. The negative terminal of power source 108 leads to one of the terminals 154 for centrifugal blower 110. The other terminal 154 is connected to terminal No. 6 of relay 170.

Figure 10:
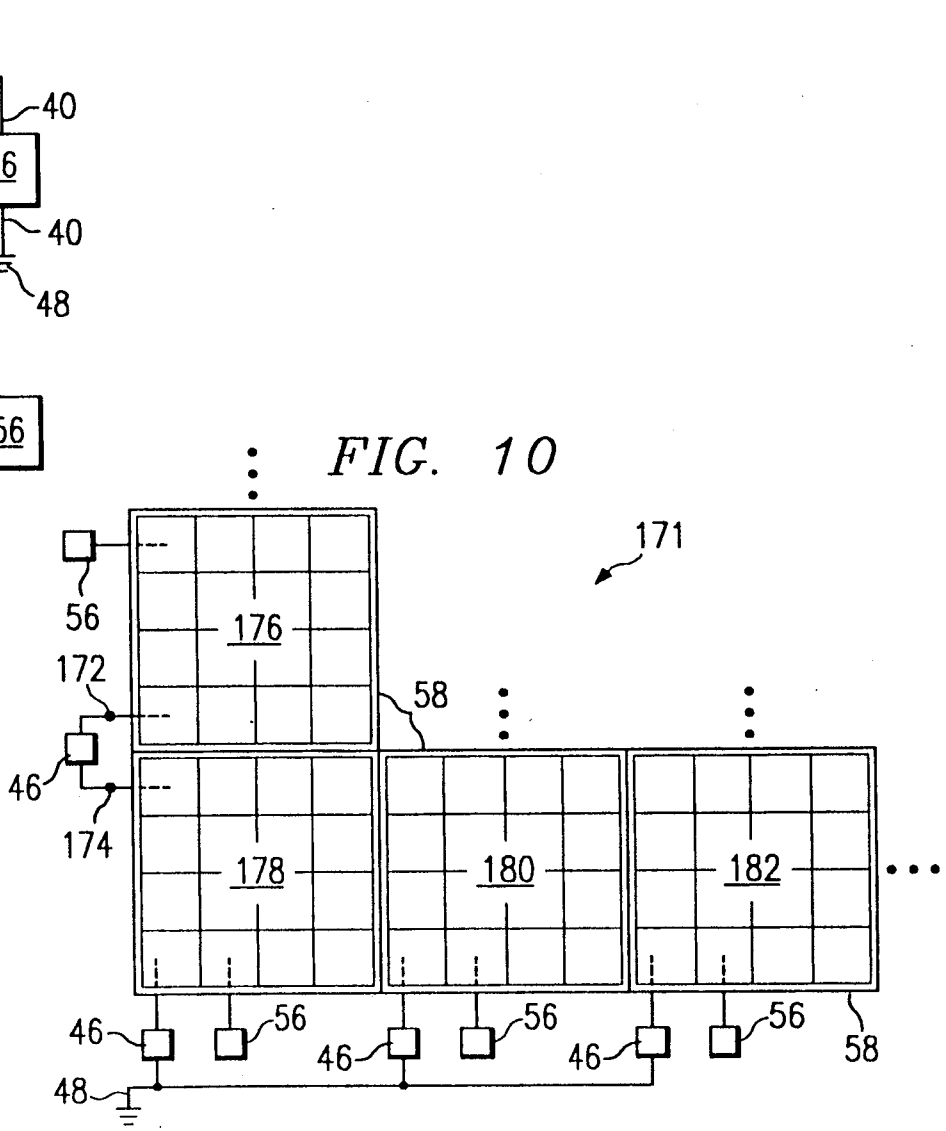
FIG. 10 is a top view of a flooring system containing multiple flooring structures.

FIG. 10 illustrates a flooring system 171 containing multiple flooring structures 176, 178, 180, and 182 which have the same structure as flooring structure 10. Each flooring structure 176, 178, 180 and 182 has a moisture detector circuit 56. Flooring structures 180 and 182 each have a variable resistance circuit 46 which is tied to a common ground 48. Since flooring structures 180 and 182 are insulated from each other, their variable resistances can be adjusted independently from the other flooring structure. As many flooring structures 10 as desired with their variable resistance circuits 46 connected to a common ground can be placed side-by-side.

Flooring structures 10 of flooring system 171 can be connected in series by connecting a variable resistance circuit 46 between flooring structures. Flooring structures 176 and 178 are connected in series by connecting a variable resistance circuit 46 between these flooring structures at points 172 and 174. The flooring structure 10 at the end of the multiple flooring structures connected in series is connected to ground 48 through a variable resistance circuit 46. As shown in FIG. 10, flooring structure 178 is connected to ground 48 through variable resistance circuit 46. When the flooring structures 10 are connected in series, each flooring structure 10 has its resistance increased by the total resistance of the flooring structures and the variable resistances 60 between it and ground. In FIG. 10, the resistance of flooring structure 176 is increased by the variable resistance 60 in variable resistance circuit 46 connected at points 172 and 174, the resistance of flooring structure 178, and the variable resistance 60 of the variable resistance circuit 46 connected to ground 48.

Flooring system 171 has several benefits. Each flooring structure 10 of flooring system 171 can be set to have a different resistance value. This is beneficial in a facility involving several different operations. For example, persons in one part of a room might be working on explosives, while in the other part of the room persons might be working on an electronic circuit board. The flooring structure 10 which is in the part of the room where the explosives are being worked on should have a lower resistance to quickly dissipate electrostatic charges. The flooring structure at the part of the room where the circuit board is being worked on should be adjusted to have a higher resistance to more slowly dissipate electrostatic charges.

While the foregoing illustrates and discloses the preferred embodiment of the invention with respect to the composition of the flooring structure, and the circuitry involved in monitoring and controlling this flooring structure, it is to be understood that many changes can be made in the composition of the flooring structure, the circuitry, and the application of the flooring structure as a matter of engineering choices without departing from the spirit and scope of the invention, as defined by the appended claims.

What is claimed is:

1. An electrostatic charge controlling flooring structure for covering a base surface, comprising:

a bottom layer comprising moisture resistant material;

a middle layer which comprises an electrically grounded lattice of conductive material affixed to said bottom layer; and a top layer of semiconductive tiles affixed to said middle layer.

2. A flooring structure as in claim 1, wherein said bottom layer of moisture resistant material comprises a planar body with support members which raise said planar body above said base surface.

3. A flooring structure as in claim 1, wherein said middle layer of conductive lattice material comprises conductive tape arranged in a lattice.

4. The flooring structure of claim 1, further comprising a variable resistance connected between said conductive lattice material and ground.

5. The flooring structure of claim 4, further comprising a monitor for measuring the resistance of said variable resistance.

6. A flooring structure as in claim 1, wherein said bottom layer of moisture resistant material comprises a planar body with support members which raise said planar body above said base surface and further comprising a moisture sensor which detects moisture underneath said planar body of said bottom layer and an alarm which is activated when said moisture sensor detects moisture.

7. The flooring structure of claim 1, further comprising a molding strip which is attached to the sides around the periphery of said flooring structure to completely electrically insulate and make moisture resistant the periphery edge of the flooring structure layers.

8. The flooring structure of claim 1, further comprising conductive epoxy for affixing said semiconductive tiles to the lower layers.

9. The flooring structure of claim 1, further comprising a support layer between said bottom layer and said middle layer.

10. The flooring structure of claim 1, further comprising a moisture sensor which detects moisture in said bottom layer.

11. The flooring structure of claim 1, further comprising a moisture dryer for drying moisture in said bottom layer.

12. An electrostatic charge controlling flooring structure for covering a base surface, comprising:

a bottom layer comprising a planar body with support members which raise said planar body above said base surface;

a middle layer comprising an electrically grounded lattice of conductive material affixed to said bottom layer;

a top layer comprising semiconductive tiles affixed to said middle layer;

a variable resistance connected between said conductive lattice material and ground; and a moisture sensor positioned and arranged to detect moisture underneath said planar body of said bottom layer.

13. A flooring structure as in claim 12, wherein said conductive lattice material comprises conductive tape arranged in a lattice.

14. The flooring structure of claim 12, further comprising a monitor for measuring the resistance of said variable resistance.

15. The flooring structure of claim 12, further comprising an alarm which is activated when said moisture sensor detects moisture.

16. The flooring structure of claim 12, further comprising a moisture dryer for drying moisture under said planar body of said bottom layer.

17. The flooring structure of claim 12, further comprising a molding strip which is attached to the sides around the periphery of said flooring structure to completely electrically insulate and make moisture resistant the periphery edge of the flooring structure layers.

18. The flooring structure of claim 12, further comprising conductive epoxy for affixing said semiconductive tiles t said lower layers.

19. The flooring structure of claim 12, further comprising a support layer between said bottom layer and said middle layer.

20. An electrostatic charge controlling flooring structure for covering a base surface, comprising:

a bottom layer comprising a planar body with support members which raise said planar body above said base surface;

a middle layer comprising an electrically grounded lattice of conductive material affixed to said bottom layer;

a top layer comprising semiconductive tiles affixed to said middle layer;

a variable resistance connected between said conductive lattice material and ground;

a moisture sensor positioned and arranged to detect moisture underneath said planar body of said bottom layer;

a monitor positioned and arranged to measure the resistance between said conductive lattice material and ground;

an alarm positioned and arranged to be activated when said moisture sensor detects moisture; and a moisture dryer positioned and arranged to dry moisture underneath said planar body of said bottom layer.

21. A flooring structure as in claim 20, wherein said conductive lattice material comprises conductive tape arranged in a lattice.

22. The flooring structure of claim 20, further comprising a centralized control and monitor circuit box which centralizes the controlling and monitoring of the operation of the flooring structure electronic circuitry.

23. The flooring structure of claim 20, further comprising a molding strip which is attached to the sides around the periphery of said flooring structure to completely electrically insulate and make moisture resistant the periphery edge of the flooring structure layers.

24. The flooring structure of claim 20, further comprising conductive epoxy for affixing said semiconductive tiles to said lower layers.

25. The flooring structure of claim 20, further comprising a support layer between said bottom layer and said middle layer.

26. An electrostatic charge controlling flooring system comprising multiple flooring structures, insulated from each other, but having the same ground, wherein each flooring structure comprises:

a bottom layer comprising a planar body with support members which raise said planar body above said base surface;

a middle layer comprising an electrically grounded lattice of conductive material affixed to said bottom layer;

a top layer comprising semiconductive tiles affixed to said middle layer.

27. The flooring system of claim 26, wherein multiple flooring structures each have a variable resistance connected between their conductive lattice material and ground.

28. The flooring system of claim 27, wherein each flooring structure further comprises a monitor for measuring the variable resistance.

29. The flooring system of claim 26, wherein multiple flooring structures are connected in series by connecting a variable resistance between adjacent flooring structures to the conductive lattice material of each flooring structure, and by connecting one of said flooring structures to ground through a variable resistance.

30. The flooring system of claim 29, wherein each flooring structure further comprises a monitor for measuring the variable resistance.

31. The flooring system of claim 26, wherein each flooring structure further comprises a moisture sensor which detects moisture underneath said planar body of said bottom layer.

32. The flooring system of claim 31, wherein each flooring structure further comprises an alarm which is activated when said moisture sensor detects moisture.

33. The flooring system of claim 26, further comprising a moisture dryer for drying moisture underneath said planar body of said bottom layer.

34. The flooring system of claim 26, wherein each flooring structure further comprises a molding strip which is attached to the sides around the periphery of said flooring structure to completely electrically insulate and make moisture resistant the periphery edge of the layers of each flooring structure which results in each flooring structure being electrically insulated from the other flooring structures.

35. A method of forming an electrostatic charge controlling flooring structure which covers a base surface, comprising the steps of:

(a) placing a bottom layer of moisture resistant material on said base surface;

(b) placing strips of electrically grounded conductive tape on top of said bottom layer in a lattice arrangement such that semiconductive tiles can be placed on top of said conductive tape with the semiconductive tape overlapping the perimeter of each semiconductive tile on its underside; and (c) placing semiconductive tiles on top of said conductive tape in such a manner that said semiconductive tape overlaps the perimeter of each said semiconductive tile on its underside.

36. The method of forming an electrostatic charge controlling flooring structure of claim 35, further including attaching said semiconductive tiles to said lower layers by conductive epoxy.

37. The method of forming an electrostatic charge controlling flooring structure of claim 35, further including attaching a molding strip to the sides around the periphery of said flooring structure to completely electrically insulate and make moisture resistant the periphery edge of the flooring structure layers.

38. The method of forming an electrostatic charge controlling flooring structure of claim 35, further including providing a support layer between said bottom layer and said strips of conductive tape.

39. The method of forming an electrostatic charge controlling flooring structure of claim 35, further including connecting a variable resistance between said strips of conductive tape and ground.

40. The method of forming an electrostatic charge controlling flooring structure of claim 39, further including providing a monitor for measuring the resistance of said variable resistance.

41. The method of forming an electrostatic charge controlling flooring structure of claim 35, further including attaching a moisture sensor which detects moisture in said bottom layer.

42. The method of forming an electrostatic charge controlling flooring structure of claim 35, further including installing moisture dryers for drying moisture in said bottom layer.

43. A method of utilizing an electrostatic charge controlling flooring structure which covers a base surface which comprises a bottom layer of moisture resistance material, a middle layer which is an electrically grounded lattice of conductive material affixed to said bottom layer, a top layer of semiconductive tiles affixed to said middle layer, a variable resistance connected between said conductive lattice material and ground, and a monitor for measuring the resistance of said variable resistance, comprising the steps of:

(a) measuring the resistance of said electrostatic charge controlling flooring structure by said monitor; and (b) adjusting said variable resistance, if necessary, so that the resistance of said electrostatic charge controlling flooring structure is the desired value.

44. A method of utilizing an electrostatic charge controlling flooring structure which covers a base surface which comprises a bottom layer of moisture resistant material, a middle layer which is an electrically grounded layer of conductive material affixed to said bottom layer, a top layer of semiconductive tiles affixed to said middle layer, a moisture sensor which detects moisture underneath said bottom layer, and a moisture dryer for drying moisture in said bottom layer when said moisture sensor detects moisture, comprising the steps of:

(a) activating said moisture sensor; and (b) activating said moisture dryer when said moisture sensor detects moisture.

45. A moisture detector circuit which detects moisture underneath a flooring structure, comprising:

a conductive foam material, which has less resistance when it absorbs moisture, having first and second terminals;

a variable resistance having a first terminal connected to a node and a second terminal connected to said first terminal of said conductive foam material;

a transistor having its control terminal connected to said second terminal of said conductive foam, having a first power terminal connected to a ground, and having a second power terminal connected to said node, said second power terminal being connected to said ground when a voltage is applied to said node and when the combined value of the resistance of the variable resistance and the resistance of the conductive foam material is low enough; and an alarm circuit which, when it is switched on, generates an output when there is a positive voltage between said node and second power terminal of said transistor.

46. The moisture detector circuit of claim 45, wherein said alarm circuit comprises a relay which, when there is a positive voltage between said node and said second power terminal of said transistor, activates a pole switch to close a contact and complete a circuit of a power source and alarm which are in series when a switch is in an on position.

47. A moisture detector circuit which detects moisture underneath a flooring structure, comprising:

a conductive foam material, which has less resistance when it absorbs moisture, having first and second terminals;

a variable resistance having a first terminal connected to a node and a second terminal connected to said first terminal of said conductive foam material;

a transistor having its control terminal connected to said second terminal of said conductive foam, having a first power terminal connected to a ground, and having a second power terminal connected to said node, said second power terminal being connected to said ground when a voltage is applied to said node and when the combined value of the resistance of the variable resistance and the resistance of the conductive foam material is low enough; and a moisture dryer circuit which, when it is switched on, activates a moisture dryer when there is a positive voltage between said node and said second power terminal of said transistor.

48. The moisture detector circuit of claim 47, wherein said moisture dryer circuit comprises a relay which, when there is a positive voltage between said node and said second power terminal of said transistor, activates a pole switch to close a contact and complete a circuit of a moisture dryer which is in series with a power source when a switch is in an on position.

49. A moisture detector circuit which detects moisture underneath a flooring structure, comprising:

a conductive foam material, which has less resistance when it absorbs moisture, having first and second terminals;

a variable resistance having a first terminal connected to a node and a second terminal connected to said first terminal of said conductive foam material;

a transistor having its control terminal connected to said second terminal of said conductive foam, having a first power terminal connected to a ground, and having a second power terminal connected to said node, said second power terminal being connected to said ground when a voltage is applied to said node and when the combined value of the resistance of the variable resistance and the resistance of the conductive foam material is low enough; and an alarm circuit which, when it is switched on, generates an output and a moisture dryer circuit which, when it is switched on, activates a moisture dryer when there is a positive voltage between said node and said second power terminal of said transistor.

* * * * *